US005095802A

United States Patent [19]

Reynolds

[11] Patent Number: 5,095,802

[45] Date of Patent: Mar. 17, 1992

[54] RAIL GUN ASSEMBLIES

[75] Inventor: Graham A. Reynolds, Coventry, England

[73] Assignee: Rolls-Royce Business Ventures Limited, Derby, England

[21] Appl. No.: 573,824

[22] Filed: Aug. 28, 1990

[30] Foreign Application Priority Data

Oct. 13, 1989 [GB] United Kingdom ..... 8923115

[51] Int. Cl.[5] ..... F41B 6/00

[52] U.S. Cl. ..... 89/8; 89/14.05; 124/3

[58] Field of Search ..... 42/76.01; 89/8, 14.05, 89/14.1; 124/3

[56] References Cited

U.S. PATENT DOCUMENTS 4,913,030 4/1990 Reynolds ..... 89/8

5,005,484 4/1991 Witt ..... 89/8

*Primary Examiner*—Stephen C. Bentley

*Attorney, Agent, or Firm*—Oliff & Berridge

[57] ABSTRACT

A rail gun assembly (10) having rail electrodes (11, 12) which are of toothed cross-section configuration and an armature (15) which provides an electrical interconnection between the rail electrodes (11,12). The armature (15) is made up of three electrically conductive portions (24,25,26) which are separated by insulators (27,28). The electrically conductive armature portions (24,25,26) are so configured that varying amounts of electrical current pass through them as the armature is operationally accelerated along the gap between the rail electrodes (11,12). Localized overheating of the armature (15) is therefore substantially reduced.

8 Claims, 4 Drawing Sheets

RAIL GUN ASSEMBLIES

Figure 1:
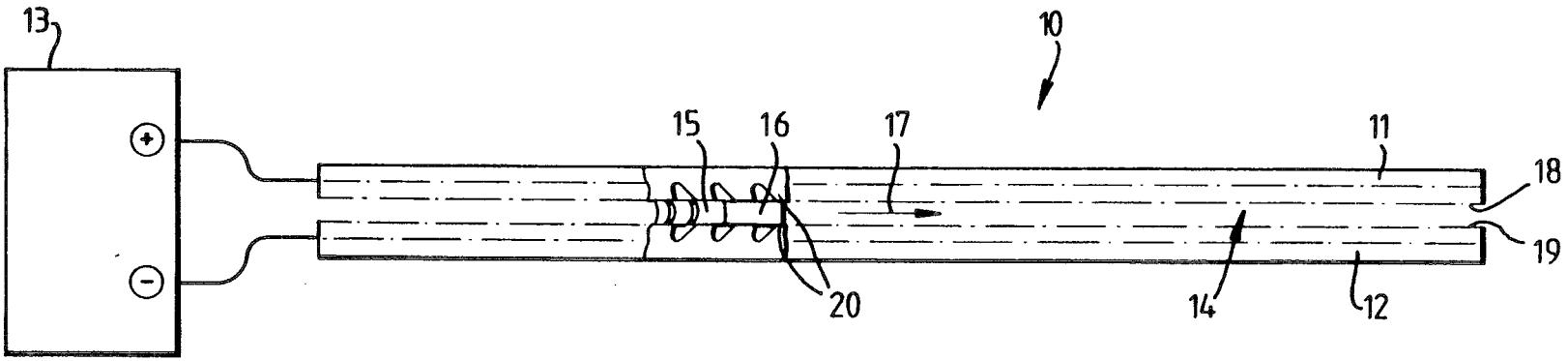

This invention relates to rail gun assemblies.

A rail gun assembly conventionally comprises two parallel rail electrodes between which is placed an electrically conductive projectile or an armature arranged to propel a projectile. When a very large electric current is passed between the electrodes via the electrically conductive projectile o armature, intense electric and magnetic fields are established. This results in the acceleration of the electrically conductive projectile or armature along the gap between the rail electrodes by the force resulting from the interaction between the magnetic field between the rail electrodes and the moving charge particles in the electrically conductive projectile or armature.

Rail gun assemblies or charged particle accelerators as they are sometimes known, can be used as effective weapon systems. If an electric current of sufficient magnitude is passed through the rail electrodes and the electrically conductive projectile or armature, very high levels of projectile acceleration can be achieved. However it has been found that if such large electric currents are utilised, undesirable localised overheating of the rail electrodes and the projectile or armature can occur. This is due in part to the fact that the electric current, in passing from one rail electrode to the other via the projectile or armature, tends to concentrate at the rearward end of the projectile or armature (with respect to its direction of travel).

It is an object of the present invention, to provide a rail gun in which such localised overheating is reduced.

According to the present invention, a rail gun assembly comprises two elongate co-extensive rail electrodes which are operationally of opposite electrical polarity and have confronting surfaces between which confronting surfaces is located an armature to be operationally accelerated in a given direction as a result of the interaction thereof with said electrically polarised rail electrodes, each of said rail electrode confronting surfaces being of regular toothed cross-section configuration so that each tooth is provided with a face which confronts a corresponding face on a tooth on the other of said rail electrodes, all of said confronting tooth faces on each rail electrode being equally spaced apart and co-planar, said armature comprising three or more electrically conductive portions which are electrically insulated from each other and so configured that each portion is capable of providing electrical interconnection between one pair of said confronting rail electrode tooth faces, the rearward portion of said armature, with respect to its operational direction of acceleration and the armature portion adjacent thereto being so arranged that during the operation of said rail gun assembly, each of said rearward armature portion and said armature portion adjacent thereto in turn makes and breaks electrical contact between sequential pairs of said rail electrode teeth confronting faces so that at any instant at least one of said rearward armature portion and said armature portion adjacent thereto provides electrical contact between at least one pair of said confronting tooth faces, the remaining armature portion or portions being so arranged that at each position of said armature along the longitudinal extents of said rail electrodes, said remaining armature portion or portions provides electrical contact between at least one pair of said rail electrode confronting tooth faces.

The invention will now be described, by way of example, with reference to the accompanying drawings in which FIG. 1 is a schematic side view of a rail gun in accordance with the present invention.

Figure 2:
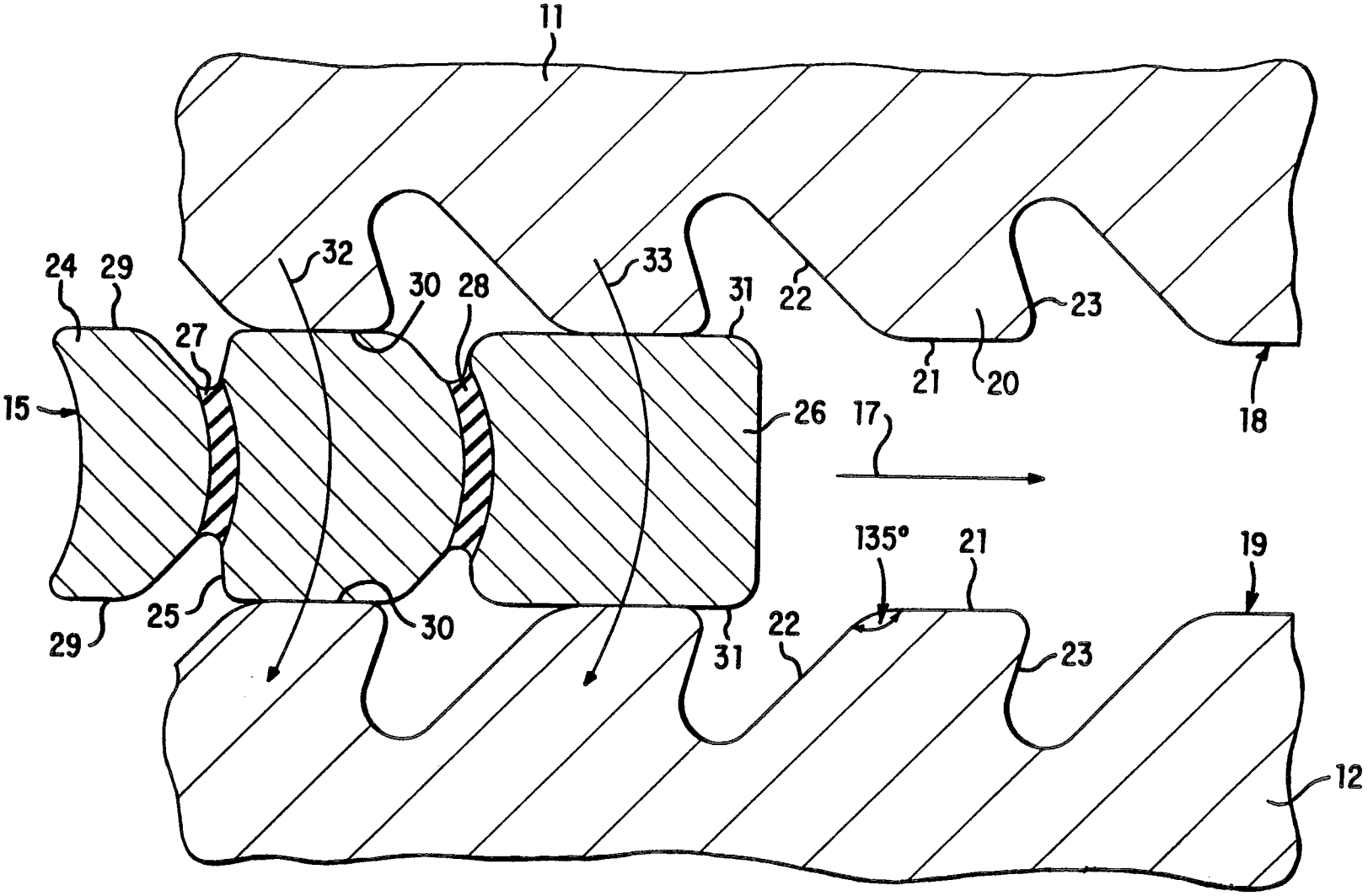
Figure 3:
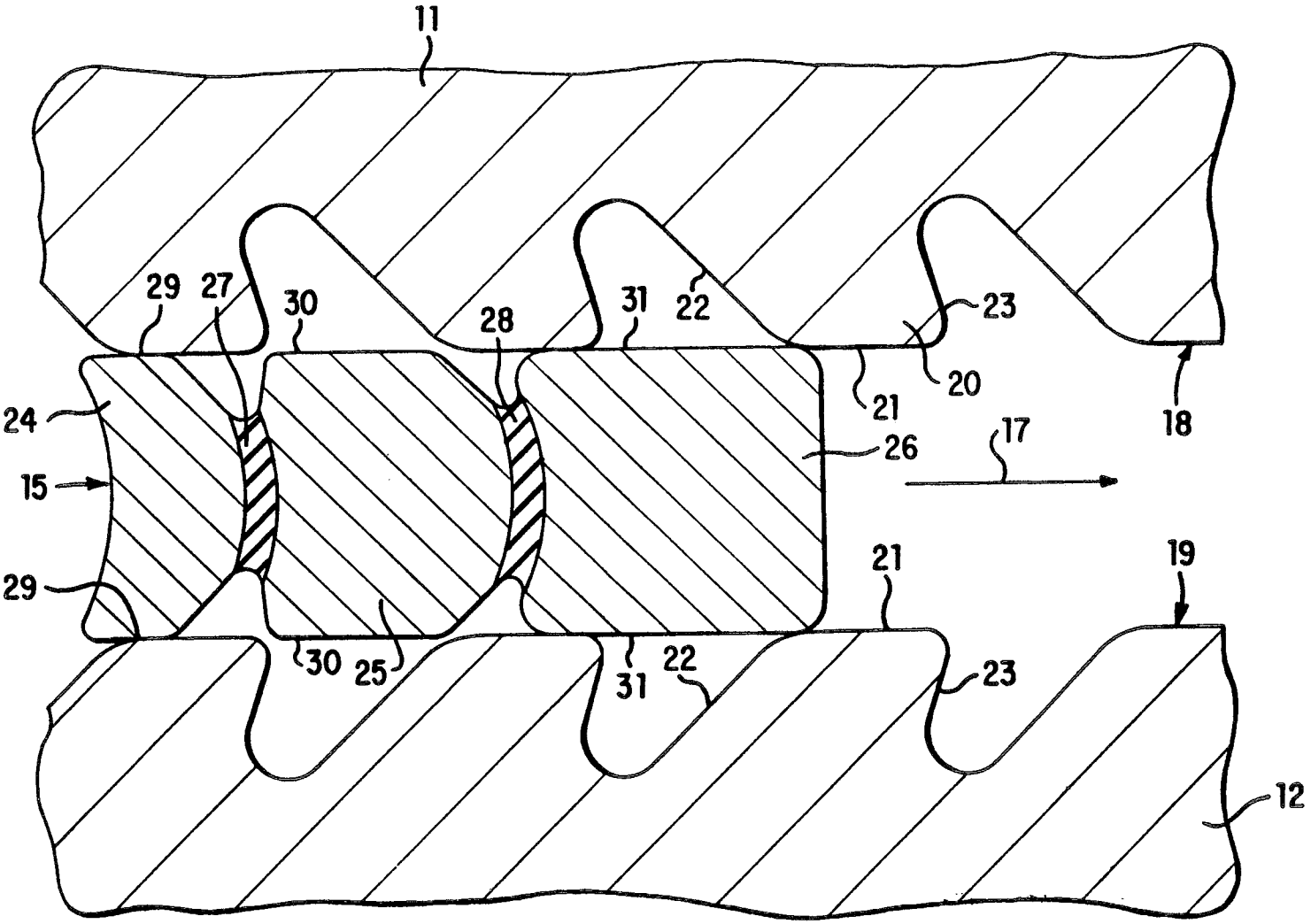
Figure 4:
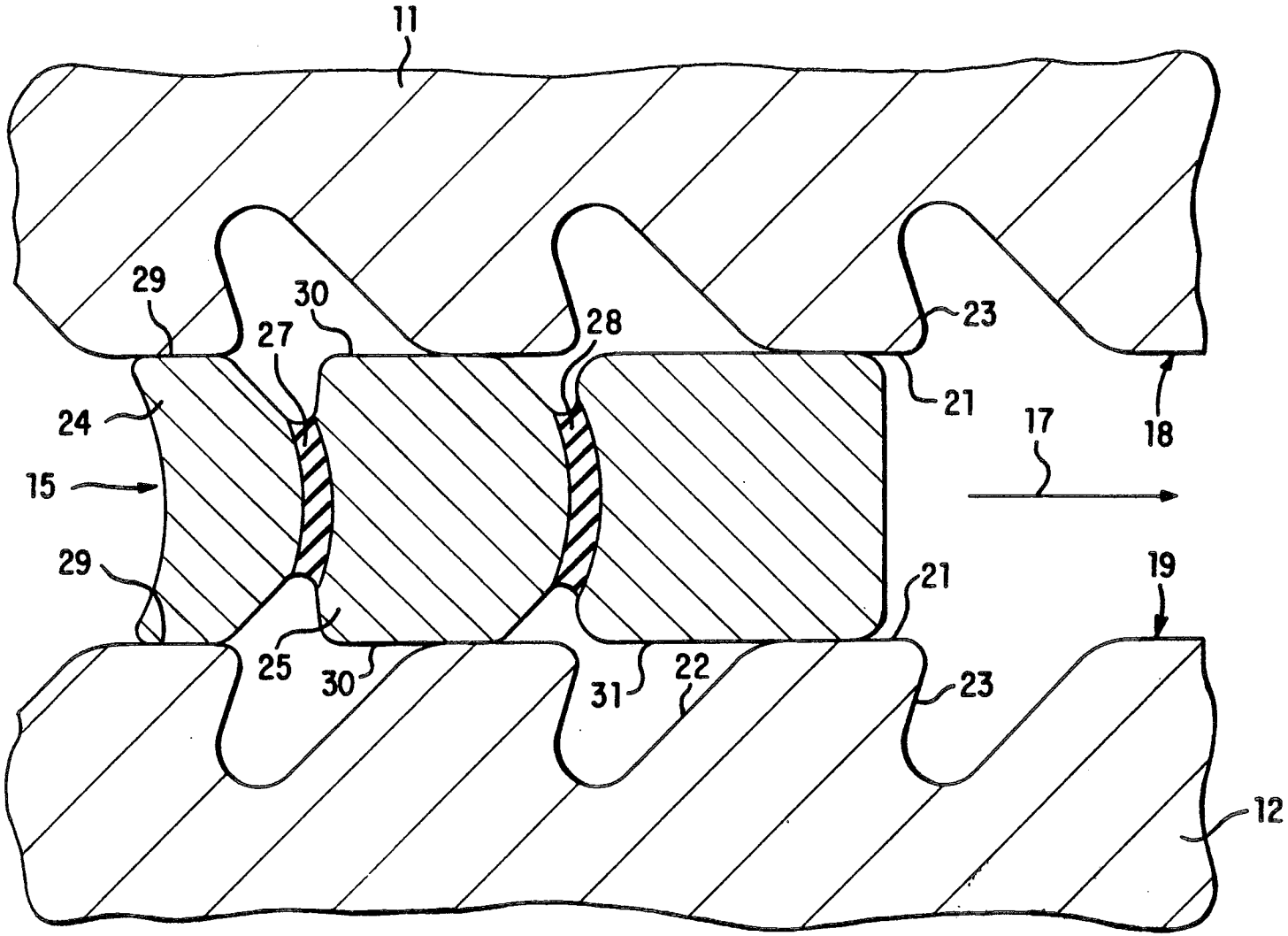

FIGS. 2,3 and 4 are sectioned side views of the same portion of the rail gun shown in FIG. 1 showing the relative dispositions of the rail electrodes of the gun and an armature translating relative to those rail electrodes, a projectile driven by the armature being deleted in the interests of clarity.

With reference to FIG. 1, a rail gun 10 comprises two elongate co-extensive rail electrodes 11 and 12 which are connected to a source of very large DC electrical output 13 so as to be of opposite polarity. A suitable source could, for instance, be a homopolar generator.

The rail electrodes 11 and 12 are equally spaced apart to define a gap 14 for the reception of an electrically conductive armature 15 and a projectile 16. The armature 15 is an electrical contact with the rail electrodes 11 and 12 so that during the operation of the source of very high electrical output 13, current flows from one rail electrode 11 to the other rail electrode 12 via the armature 15. Intense electric and magnetic fields resulting from this current flow cause rapid acceleration of the armature 15 and hence the projectile 16 in the direction indicated by the arrow 17 until both are ejected at very high velocity from the rail gun 10.

It will be appreciated that although in the interests of clarity only the rail electrodes 11 and 12 of the rail gun 10 are depicted in FIG. 1, other constraining means in the form of a gun barrel (not shown) in which the rail electrodes 11 and 12 are located are present to ensure that the armature 15 and projectile 16 follow the correct path between the rail electrodes 11 and 12. Moreover, although an armature 15 is depicted as propelling a projectile 16, the armature 15 could be deleted and the projectile 16 arranged to be electrically conductive and of the same general configuration as the armature 15.

The confronting surfaces 18 and 19 of the rail electrodes 11 and 12 respectively are of similar regular toothed cross-section configuration as can be seen more clearly if reference is now made to FIG. 2. FIG. 2 shows a portion of the rail electrodes 11 and 12 in greater detail.

Each tooth 20 extends transversely to the longitudinal extent of its respective rail electrode 11,12 and is provided with a face 21 which confronts and is parallel with a corresponding face 21 on a tooth 20 on the other rail electrode 12. The faces 21 on each rail electrode 11,12 are co-planar and equally spaced apart from each other.

The leading flank 22 of each tooth (with respect to the direction 17 of projectile 16 travel) is inclined at an angle of approximately 135° to the plane of the tooth confronting face 21. The trailing flank 23 of each tooth 20 is however inclined to the tooth confronting face 21 by an angle which is somewhat less than 90°.

The toothed configuration of the rail electrode confronting surfaces 18 and 19 and the inclination of the leading and trailing tooth flanks 22 and 23 ensures that the electrical current which flows in operation along the rail electrodes 11 and 12 via the armature 15 does not concentrate in the regions immediately adjacent the rail electrode confronting surfaces 18 and 19 and cause overheating in those regions.

The toothed configuration of the rail electrode confronting surfaces 18 and 19 also facilitates the novel manner in accordance with the present invention in which the armature 15 provides electrical interconnection between the rail electrodes 11 and 12. In order to provide this electrical interconnection, the armature 15 is constituted by three electrically conductive portions 24,25 and 26 which are interconnected in series by two electrically insulating members 27 and 28. Each of the electrically conductive armature portions 24,25 and 26 is of such a thickness that it is capable of bridging the space between confronting tooth faces 21 so as to provide electrical contact between those faces 21. The electrically insulating portions 27 and 28 of the armature 15 are, on the other hand, of a lesser thickness than the electrically conductive portions 24,25 and 26 so that they do not contact the confronting tooth faces 21 and each is of such a length that the electrically conductive portions 24,25 and 26 are equally spaced apart from each other by a distance which is approximately one half of the length of each confronting tooth face 21.

The electrically conductive armature portions 24,25 and 26, are, as can be seen in FIG. 2, of differing lengths. More specifically the rearward portion 24 (with respect to the direction 17 of projectile 16 travel) is of the shortest length so that those parts 29 thereof which make electrical contact with the tooth confronting faces 21 are approximately half the length of each tooth confronting face 21. The mid portion 25 of the armature 15 has parts 30 making electrical contact with the tooth confronting faces 21 which are approximately equal in length to each tooth confronting face 21. Finally the forward portion 26 of the armature 15 has parts 31 which make electrical contact with the tooth confronting faces 21 which are approximately twice the length of each tooth confronting face 21.

Prior to the application of a potential difference across the rail electrodes 11 and 12, the armature 15 is positioned in the manner shown in FIG. 2. In that position, the rearward armature portion 24 does not contact any of the tooth confronting faces 21 whereas the contact area between the mid armature portion 25 and an opposed pair of tooth confronting faces 21 is at a maximum. The forward armature portion 26 on the other hand is sufficiently long that at each position thereof along the longitudinal extents of the rail electrodes 11 and 12, it provides electrical contact between at least one pair of confronting tooth faces 21.

When a potential difference is applied across the rail electrodes 11 and 12, an electric current flows between them via the mid and forward armature portions 25 and 26 respectively as indicated by the arrows 32 and 33. Since the current attempts to follow the shortest path between the rail electrodes 11 and 12, the majority of the current flows through the mid armature portion 25 while the remainder flows through the forward armature portion 26. In fact approximately 65% of the current flows through the mid armature portion 25.

The passage of the electric current through the mid and forward armature portions 25 and 26 causes the armature 15 to travel in the direction indicated by the arrow 17. This results in a progressive decrease in the contact area between the mid armature portion 25 and the confronting tooth faces 21 with which it cooperates and a progressive increase in the contact area between the rearward armature portion 24 and the same pair of confronting tooth faces 21 until eventually the armature 15 reaches the position shown in FIG. 3. In that position, the mid armature portion 25 is completely out of electrical contact with a pair of confronting tooth faces 21 and the contact area between the rearward armature portion 24 and the confronting tooth 21 previously interconnected by the mid armature portion 25 is at a maximum. In addition, the forward armature portion 26 provides an interconnection between two pairs of confronting tooth surfaces 21. As stated previously the current attempts to follow the shortest path between the rail electrodes 11 and 12. This results in approximately 80% of the current flowing through the rearward armature portion 24, 15% of the current flowing through the rear region of the forward armature portion 24 and the remainder of the current flowing through the front region of the forward armature portion 26.

By the time that the armature has reached the position shown in FIG. 3, all current flow through the mid armature portion 25 has progressively reduced to zero. This gives the mid armature portion 25 time to cool down after being heated by the passage of a large current therethrough.

At this point, the current which has passed through and is still passing through the forward armature portion 26 is comparatively small and so heating effects as a result thereof are not a problem. Since 80% of the current now flows through rearward armature portion 29, it rapidly heats up. However as the armature 15 continues to travel in the direction indicated by the arrow 17, while the contact area between the rearward armature portion 24 and the confronting tooth faces 21 remains constant, the mid armature portion 25 contacts the next pair of confronting tooth faces 21 and the contact area between them progressively increases until the position shown in FIG. 4 is reached. At this position, 60% of the current between the rail electrodes 11 and 12 flow through the rearward armature portion 24, 25% of the current flows through the mid armature portion 25 and the remainder flows through the forward armature portion 26 which, by this time only interconnects one pair of confronting tooth faces 21.

It will be seen therefore that as the armature 15 travels in the direction indicated by the arrow 17, each of the rear and mid armature portions 24 and 25 in turn makes and breaks electrical contact with a confronting pair of tooth faces 21. The electric current through each of the rear and mid portions 24 and 25 therefore progressively increases from zero to a maximum value and back to zero again. This ensures that each of the rearward and mid armature portions 24 and 25 is only exposed to the maximum current for a short period before that current reduces to zero, thereby providing a period in which the rearward or mid aperture portion is allowed to cool.

The forward armature portion 26 does not carry a sufficiently high current at any time to be in danger of overheating and so it is acceptable for it to be in constant electrical contact with at least one pair of confronting tooth faces 21. Indeed, if so desired, further armature portions of a length equal to or greater than that of the forward armature portion 26 may be provided in front of the forward armature portion 26 so as to reduce, to a certain degree, the current carried by the rearward and mid armature portions 24 and 25.

It will be seen therefore that the configurations of the rail electrodes 11 and 12 and the armature 15 in accordance with the present invention ensures that the electric current which operationally flows through the armature 15 is not exclusively concentrated in the rearward portion thereof. Instead, the current path through the armature 15 is constantly changing, thereby ensuring that problems of localised overheating of the armature and the rail electrodes are substantially reduced.

I claim:

1. A rail gun assembly comprising two elongate co-extensive rail electrodes which are arranged to be operationally of opposite electrical polarity and have confronting surfaces between which confronting surfaces is located an armature to be operationally accelerated in a given direction as a result of the interaction thereof with said electrically polarised rail electrodes, each of said rail electrode confronting surfaces being of regular toothed cross-section configuration so that each tooth is provided with a face which confronts a corresponding face on a tooth on the other of said rail electrodes, all of said confronting tooth faces on each rail electrode being equally spaced apart and co-planar, said armature comprising at least three electrically conductive portions which are electrically insulated from each other and so configured that each portion is capable of providing electrical interconnection between one pair of said confronting rail electrode tooth faces, the rearward portion of said armature with respect to its operational direction of acceleration and the armature portion adjacent thereto being so arranged that during the operation of said rail gun assembly each of said rearward armature portion and said armature portion adjacent thereto in turn makes and breaks electrical contact between sequential pairs of said rail electrode teeth confronting faces so that at any instant at least one of said rearward armature portion and said armature portion adjacent thereto provides electrical contact between at least one pair of said confronting tooth faces, the remaining at least one armature portion being so arranged that at each position of said armature along the longitudinal extents of said rail electrodes, said remaining at least one armature portion provides electrical contact between at least one pair of said confronting rail electrode tooth faces.

2. A rail gun assembly as claimed in claim 1 wherein the distance between each confronting tooth face and the confronting tooth face adjacent thereto on the same rail electrode equals the distance across each confronting tooth face in the direction of armature acceleration.

3. A rail gun assembly as claimed in claim 2 wherein the distance between said armature electrically conductive portions in the direction of armature acceleration equals half the distance across each confronting tooth face in the direction of armature acceleration.

4. A rail gun assembly as claimed in claim 3 wherein the rearward electrically conductive portion of said armature has a longitudinal extent equal to half the distance across each confronting tooth face in the direction of armature acceleration.

5. A rail gun assembly as claimed in claim 4 wherein the electrically conductive portion of said armature adjacent to rearward electrically conductive portion has a longitudinal extent equal to the distance across each confronting tooth face in the direction of armature acceleration.

6. A rail gun assembly as claimed in claim 1 wherein each of said teeth is provided with leading and trailing flanks with respect to the direction of armature acceleration, said leading and trailing flanks being inclined with respect to the confronting face of said tooth.

7. A rail gun assembly as claimed in claim 6 wherein the angle between the leading flank and confronting face of each tooth is approximately 135°.

8. A rail gun assembly as claimed in claim 7 wherein the angle between the trailing flank and confronting face of each tooth is less than 90°.

* * * * *